US006377876B1

(12) United States Patent
Hedeen et al.

(10) Patent No.: US 6,377,876 B1
(45) Date of Patent: Apr. 23, 2002

(54) LOCOMOTIVE DIAGNOSTIC SYSTEM

(75) Inventors: Robert Arvin Hedeen, Clifton Park; Steven Hector Azzaro, Schenectady; Robert John Naumiec, Clifton Park; Slawomir Marian Zaremba, Niskayuna, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/213,350

(22) Filed: Dec. 17, 1998

(51) Int. Cl.[7] ..... G06F 17/00; G06F 7/00

(52) U.S. Cl. ..... 701/19; 701/29; 701/34; 701/36; 246/1 R

(58) Field of Search ..... 701/19, 29, 30, 701/31, 34, 36, 99, 115; 73/117.3, 119 R; 706/45, 50; 246/1 R, 1 C

(56) References Cited

U.S. PATENT DOCUMENTS

| | | | | |
|---|---|---|---|---|
| 5,258,923 A | | 11/1993 | Imam et al. | 364/508 |
| 5,433,111 A | | 7/1995 | Hershey et al. | 73/593 |
| 5,806,011 A | | 9/1998 | Azzaro et al. | 701/99 |
| 5,845,272 A | * | 12/1998 | Morjaria et al. | 706/50 |
| 5,961,567 A | | 10/1999 | Azzaro et al. | 701/99 |
| 6,175,934 B1 | | 1/2001 | Hershey et al. | 714/25 |

OTHER PUBLICATIONS

Hershey et al., "Method and Apparatus for Enhanced Service Quality Through Remote Diagnostics," S.N. 08/990, 913, filed Dec. 15, 1997 (RD–24,928).

Azzaro et al., "Method and Apparatus for Peformance Based Assessment of Locomotive Diesel Engines," S.N. 09/145, 077, filed Sep. 1, 1998 (RD–26,466).

Frarey et al., "Vibration Signature Analysis at the Eddystone Plant of Philadelphia Electric," EPRI Report CS–2920 presented at the Incipient Failure Detection for Fossil Power Plant Components 1982 Conference & Workshop, pp. 3–35 to 3–43.

* cited by examiner

*Primary Examiner*—Gertrude Arthur
(74) *Attorney, Agent, or Firm*—Enrique Abarca; Patrick K. Patnode

(57) ABSTRACT

A locomotive diagnostic system. A first sensor outputs a measurement of a first state variable (such as vibration) of a first locomotive component, such as a blower fan bearing set, and a second sensor outputs a measurement of a second state variable (such as rotational speed) of a second locomotive component, such as a blower fan shaft. The first state variable is indicative of the operation of the first component and is dependent on the second state variable. Data represents, for each of a number of different values of the second state variable, first, second, and third ranges of values of the first state variable which indicate, respectively, normal, worn, and failed operation of the first component. A mechanism, such as a digital computer, determines if the measurement of the first state variable is within the first, second, or third range of values of the first state variable for the measurement of the second state variable.

17 Claims, 4 Drawing Sheets

LOCOMOTIVE DIAGNOSTIC SYSTEM

BACKGROUND OF THE INVENTION

The present invention relates generally to locomotives, and more particularly to a locomotive diagnostic system.

Locomotives include diesel-electric locomotives used by railroads to haul passengers and freight. Current locomotive diagnostic systems include traction speed sensors and water and oil temperature and pressure sensors which give an overall indication that there is a present problem with the locomotive but do not indicate the specific component or cause of the problem. Federal regulations require that locomotives be serviced every 92 days. While in the shop, each locomotive undergoes a conventional service and maintenance check up. Such check ups include partial locomotive disassembly to expose replaceable units and visual inspection and possibly electrical testing of the replaceable units for problems (such as visual inspection for scorch marks or a "frozen" fan rotor or electrical testing of a fan for proper operation). Defective replaceable units are replaced. A replaceable unit (RU) is the smallest replaceable assembly of parts. For example, locomotives have several fans needed to cool various components including the motor or motors. Badly worn fan bearings eventually will lead to cooling fan stoppage, and a locomotive motor can overheat and fail without adequate cooling from a cooling fan. The cooling fan, and not the fan bearing, is the replaceable unit. A locomotive that becomes disabled while in operation between shop visits is a cost liability to the railroad.

What is needed is a system and method for identification of problem (i.e., soon-to-fail) replaceable units (RU's) of a locomotive before these problem units actually fail.

BRIEF SUMMARY OF THE INVENTION

In a first embodiment, the locomotive diagnostic system is for a locomotive having a first component (such as a bearing set of a blower fan) and a second component (such as a shaft of the blower fan). The system includes a first sensor which is located in sensing proximity to the first component and which outputs a measurement of a first state variable (such as vibration) of the first component. The first state variable is indicative of the operation of the first component, and the first state variable is dependent on a second state variable (such as rotational speed) of the second component. The system also includes a second sensor which is located in sensing proximity to the second component and which outputs a measurement of the second state variable. The system additionally includes data representing, for each of a number of different values of the second state variable, a first range of values of the first state variable which indicates a normal operation of the first component, a second range of values of the first state variable which indicates a worn operation of the first component, and a third range of values of the first state variable which indicates a failed operation of the first component. The system moreover includes a mechanism for determining if the measurement of the first state variable is within the first, second, or third range of values of the first state variable for the measurement of the second state variable.

In one example, the mechanism is a computer which directs the first and second sensors to take additional measurement, which calculates a deterioration rate of the first state variable from the additional measurements, and which predicts a time-to-failure for the first component based on a latest measurement of the first state variable, the deterioration rate, and the data.

In another example, the system also includes an additional sensor which is located in sensing proximity to the first component, which outputs a measurement of an additional state variable (such as acoustic noise) of the first component. The additional state variable is indicative of the operation of the first component, and the additional state variable is dependent on the second state variable of the second component.

Several benefits and advantages are derived from the invention. The locomotive diagnostic system of the invention indicates to the railroad that a locomotive component is worn and needs replacement. The locomotive diagnostic system of the invention also gives the railroad a prediction of the time-to-failure of the locomotive component. Knowing a predicted time-to-failure allows the railroad to minimize locomotive downtime by replacing the worn locomotive component (or the larger replaceable unit containing the component if the component itself is not replaced) before the component fails while the locomotive is hauling passengers or freight.

DETAILED DESCRIPTION OF THE INVENTION

Figure 1:
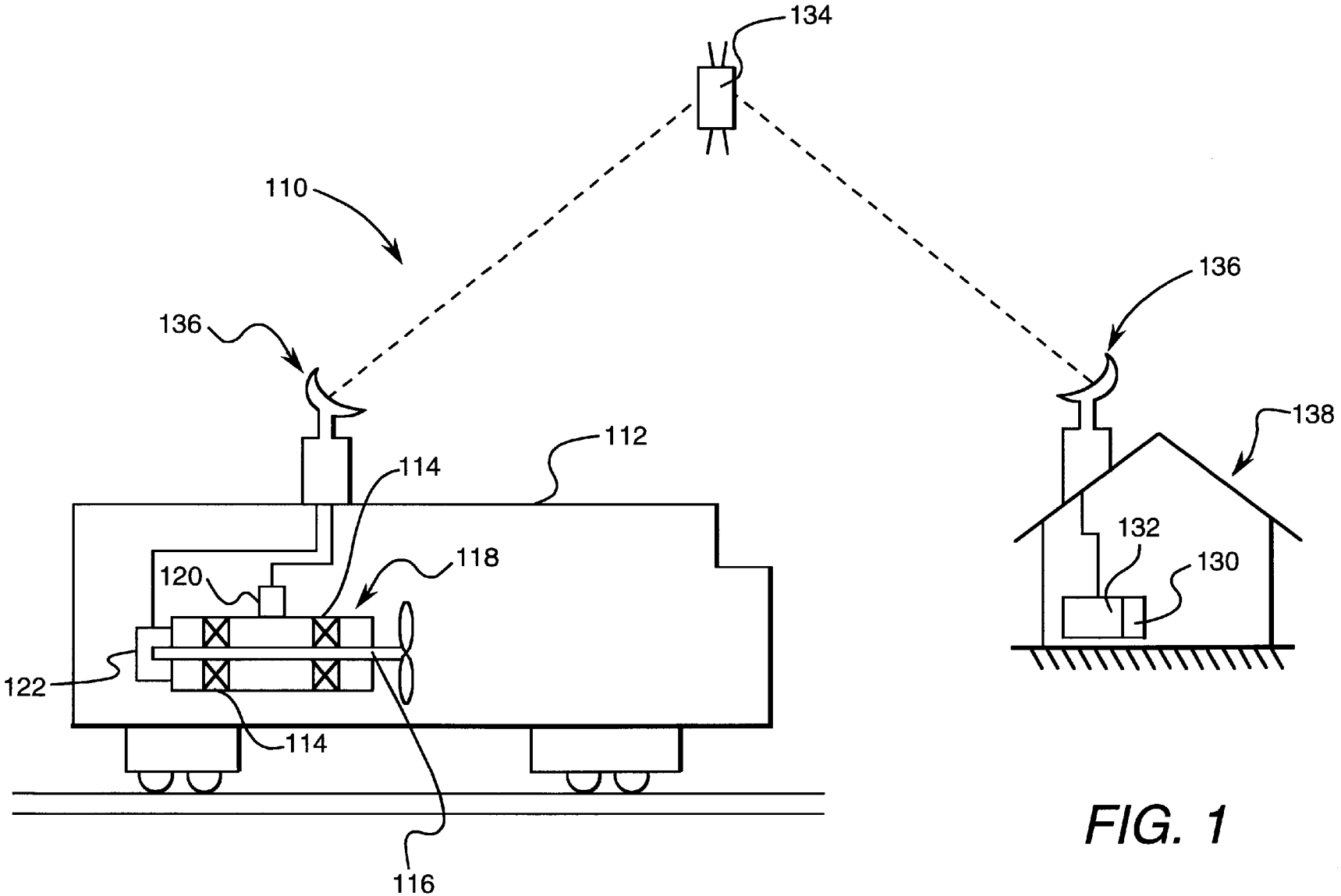
FIG. 1 is a schematic cross sectional view of a first embodiment of the locomotive diagnostic system of the invention.

Referring now to the drawings, wherein like numerals represent like elements throughout, FIG. 1 shows a first embodiment of the locomotive diagnostic system 110 of the present invention. The system 110 is for a locomotive 112 having a first component 114 and a second component 116. In this example, the first component 114 is a bearing set, the second component 116 is a shaft, and the first and second components 114 and 116 belong to a common locomotive replaceable unit 118 which is a locomotive bearing fan.

The locomotive diagnostic system 110 includes a first sensor 120 and a second sensor 122. The first sensor 120 is disposed in sensing proximity to the first component 114 and outputs a measurement of a first state variable of the first component 114. Likewise, the second sensor 122 is disposed in sensing proximity to the second component 116 and outputs a measurement of a second state variable of the second component 116. The first state variable is indicative of the operation of the first component 114, and the first state variable is dependent on the second state variable of the second component 116. In one example, the first state variable is vibration, the second state variable is rotational speed, the first sensor 120 is a vibration sensor, and the second sensor 122 is a rotational speed sensor.

Figure 2:
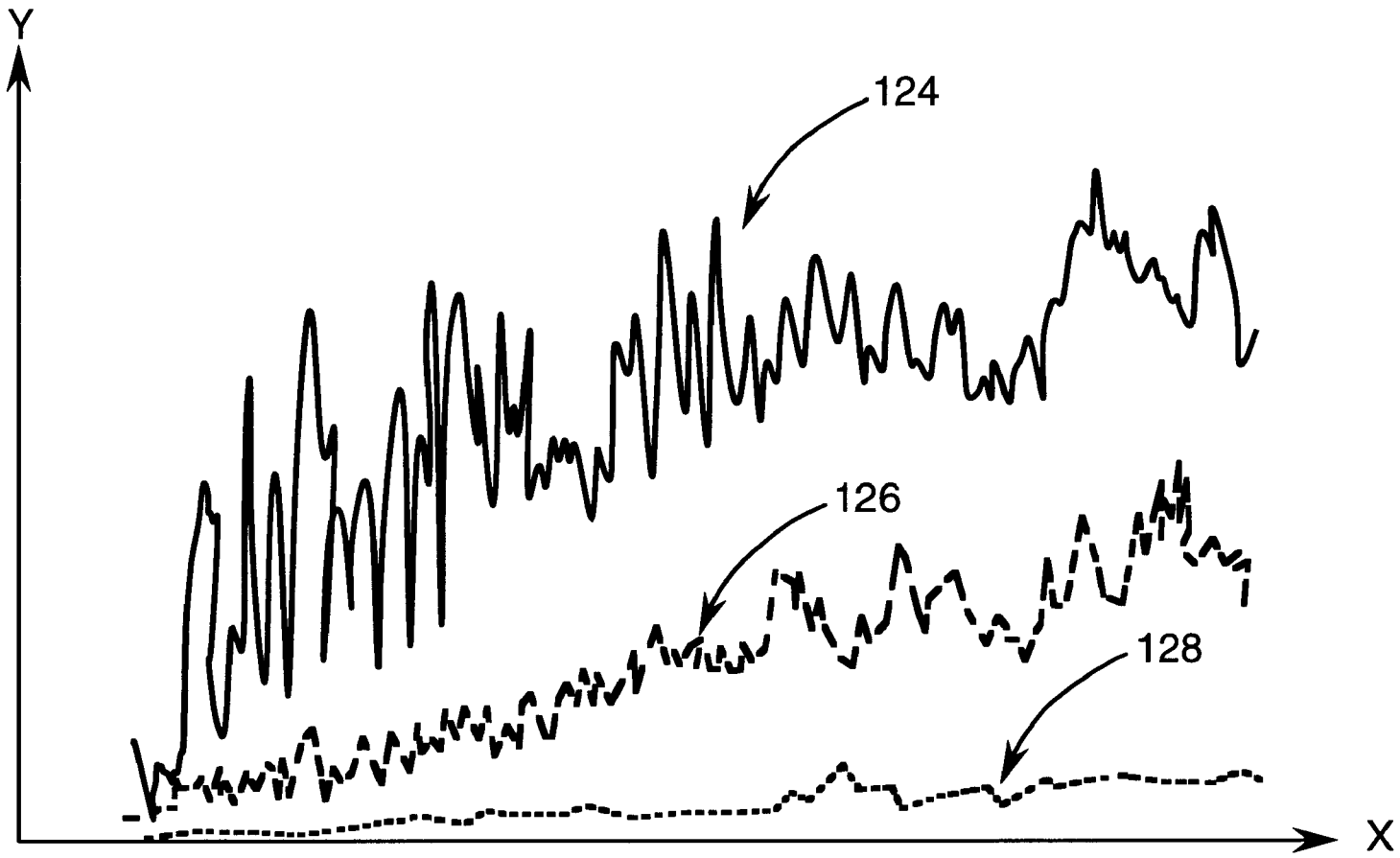
FIG. 2 depicts a graphical embodiment of an example of the data portion of the locomotive diagnostic system of the invention, wherein the Y axis represents bearing vibration of a locomotive blower fan, the X axis represents rotational speed of the shaft of the blower fan, the upper "curve" represents a failed bearing, the middle "curve" represents a worn bearing, and the lower "curve" represents a normal bearing, wherein the "curves" are derived from historical measurements of known failed, worn, and normal locomotive fan blower bearings.

The locomotive diagnostic system 110 also includes data representing, for each of a plurality of different values of the second state variable, a first range of values of the first state variable which indicates a normal operation of the first component 114, a second range of values of the first state variable which indicates a worn operation of the first component 114, and a third range of values of the first state variable which indicates a failed operation of the first component 114. A graphical embodiment of an example of the data is shown in FIG. 2, wherein the Y axis represents bearing vibration of a locomotive blower fan, the X axis represents rotational speed of the shaft of the blower fan, the upper "curve" 124 represents a failed bearing, the middle "curve" 126 represents a worn bearing, and the lower curve 128 represents a normal bearing. Vibration is expressed in g's (gravitational units) and rotational speed is expressed in rpm (revolutions per minute). The Y axis extends from zero (bottom-most value) to four (top-most value), and the X axis extends from zero (left-most value) to 1,800 (right-most value). In this example, assume for an X value of 900 that the value of the failed "curve" 124 is 3, that the value of the worn "curve" 126 is 1.6, and that the value of the normal "curve" 128 is 0.2. Then, in one enablement, the artisan can choose the third range of values as 3 and above, the second range of values as between 0.2 and 3, and the first range of values as 0.2 and below. In another enablement, the artisan can choose the third range of values as 2.3 (midway between the failed and worn values) and above, the second range of values as between 0.9 and 2.3, and the first range of values as 0.9 (midway between the worn and normal values).and below. In this example, the data (e.g., the "curves" 124, 126, and 128) are derived from historical measurements of the first state variable from known failed, worn, and normal first components 114 and from historical same-time corresponding measurements of the second state variable of the second component 116. The data can be depicted as continuous or discrete data, and discrete data can be shown in table form or can be stored as a database on a computer-readable medium such as on a computer floppy disk or on a computer hard drive 130.

The locomotive diagnostic system 110 additionally includes means for determining if the measurement of the first state variable is within the first, second, or third range of values of the first state variable for the measurement of the second state variable. This can be a worker comparing the measurements of the first and second state variables with the "curves" 124, 126, and 128 in FIG. 2. The determining means can be analog and/or digital electrical and/or electronic circuitry which compares the first and second state variables with the data. In one example, the determining means is a digital computer 132 having the hard drive 130, wherein the digital computer 132 utilizes the data stored as a database on the hard drive 130 along with the measurements of the first and second state variables to determine if the first component 114 is a failed, worm, or normal first component.

In one enablement, the computer 132 directs the first and second sensors 120 and 122 to take additional measurements. The computer 132 also calculates a deterioration rate of the first state variable from the additional measurements. The computer additionally predicts a time-to-failure for the first component 114 based on a latest measurement of the first state variable, the deterioration rate, and the data. In one example, the deterioration rate is assumed to be constant over time and the difference between the "lowest" failure value of the third range of values and the latest measurement of the first state variable is calculated, and the time to failure is computed by dividing that difference by the deterioration rate. In this example, the third range of values is 3 and above, that the deterioration rate is 0.1 g per day, and that the latest measurement of the first state variable is 2.3 g. Then, the time-to-failure is predicted as being seven days.

In one example, the first and second sensors 120 and 122 are disposed onboard the locomotive 112. The computer 132 can be located remote from the locomotive 112 as shown in FIG. 1. Here, the first and second sensors 120 and 122 are in satellite communication with the computer 132 through a communications satellite 134 and separate satellite communication units 136 located on the locomotive 112 and near (or otherwise in digital communication with) the computer 132. It is noted that the results of the measurements of the first and second state variables could also be telephoned or radioed in to the center 138 housing the computer 132.

Figure 3:
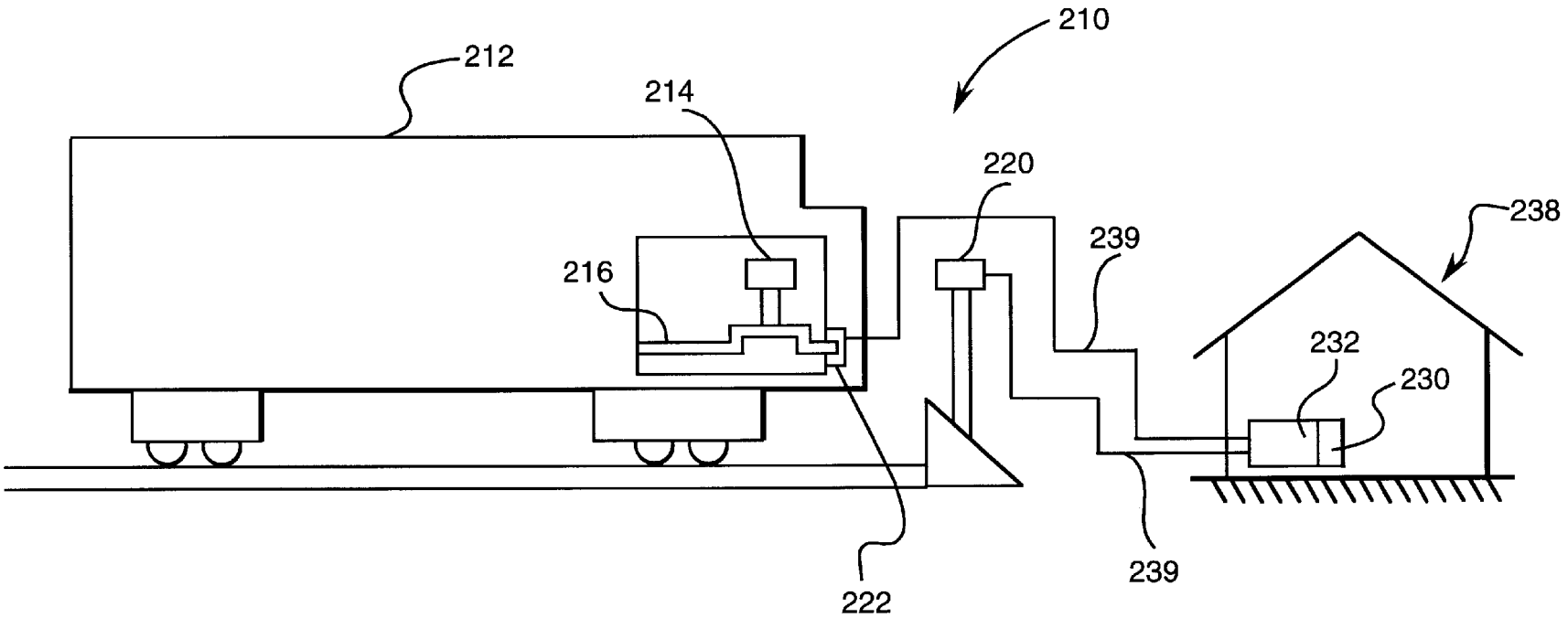
FIG. 3 is a schematic cross sectional view of a second embodiment of the locomotive diagnostic system of the invention.

Referring again to the drawings, FIG. 3 shows a second embodiment of the locomotive diagnostic system 210 of the present invention. Locomotive diagnostic system 210 is identical to the previously-discussed locomotive diagnostic system 110 with differences as hereinafter noted. In locomotive diagnostic system 210, the first state variable is acoustic noise, the second state variable is rotational speed, the first sensor 220 is an acoustic sensor, and the second sensor 222 is a rotational speed sensor. In this embodiment, the first component 214 defines a first locomotive replaceable unit, and the second component 216 belongs to, and in this case defines, a second locomotive replaceable unit which is different from the first locomotive replaceable unit. Here, the first component 214 is a locomotive engine cylinder head, and the second component 216 is a locomotive engine crankshaft. Other replaceable units include, without limitation, air compressors, turbocharger units, and radiator fans.

In this example, the first sensor 220 is disposed at trackside, and the second sensor 222 is disposed onboard the locomotive 212. The computer 232, including its hard drive 230, is disposed nearby the locomotive 212. Here, the locomotive 212 is driven up and brought close to the computer center 238, and the connections of the sensors 220 and 222 with the off-board computer 232 are made by cables 239.

Figure 4:
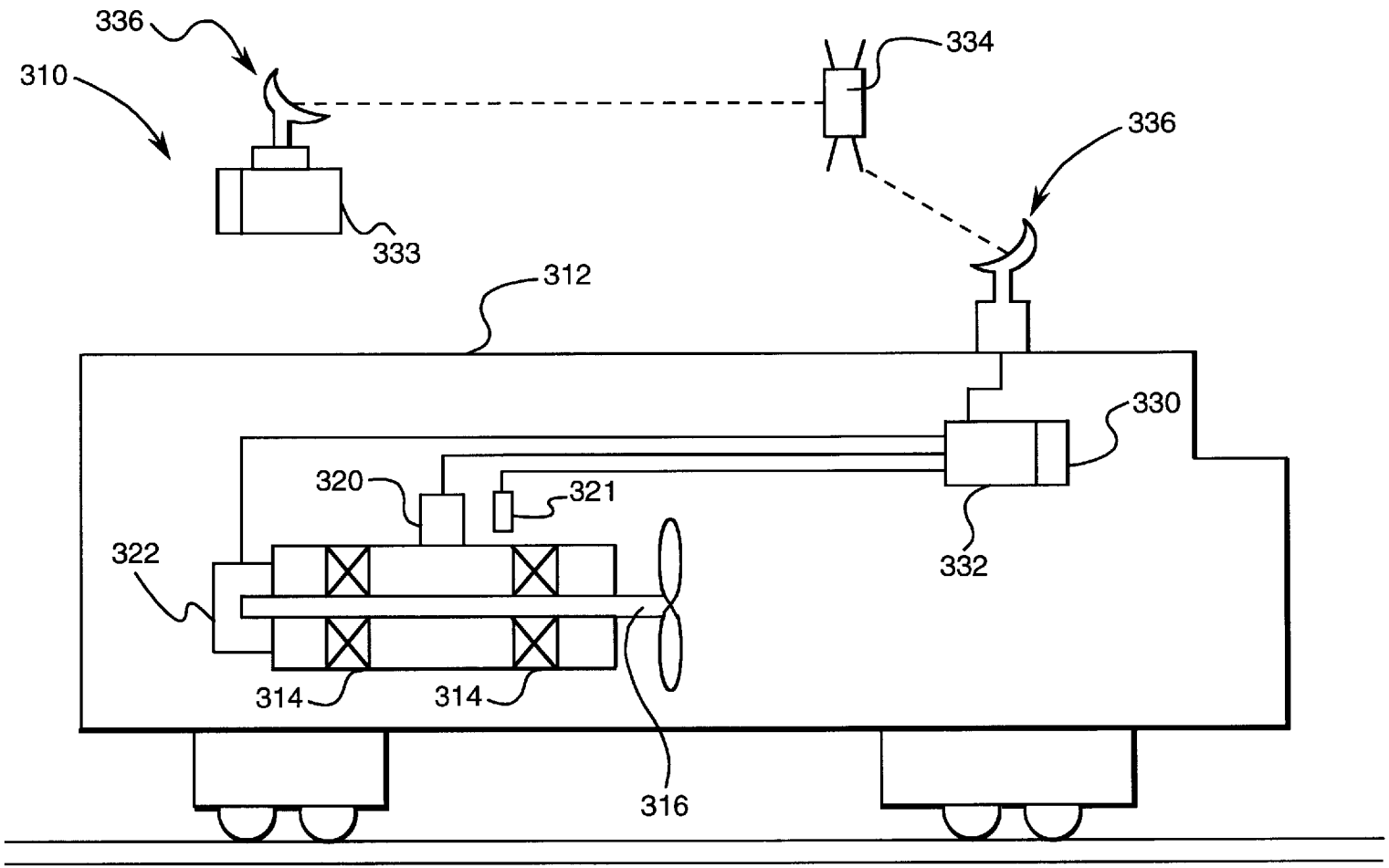
FIG. 4 is a schematic cross sectional view of a third embodiment of the locomotive diagnostic system of the invention.

A third embodiment of the locomotive diagnostic system 310 of the present invention is shown in FIG. 4. The locomotive diagnostic system 310 is identical to the previously-discussed locomotive diagnostic system 110 with additions and differences as hereinafter noted. The system 310 also includes an additional sensor 321 which is disposed in sensing proximity to the first component 314. The additional sensor 321 outputs a measurement of an additional state variable of the first component 314. The additional state variable is indicative of the operation of the first component 314, and the additional state variable is dependent on the second state variable of the second component 316. In this example, the data also represents, for each of the plurality of different values of the second state variable, a fourth range of values of the additional state variable which indicates a normal operation of the first component 314, a fifth range of values of the additional state variable which indicates a worn operation of the first component 314, and a tertiary range of values of said additional state variable which indicates a failed operation of the first component 314.

Here, the determining means also determines if the measurement of the additional state variable is within the fourth, fifth, or tertiary range of values of the additional state variable for the measurement of the second state variable. In one enablement, the determining means also determines if the first component 314 is undergoing normal, worn, or failed operation based on the worst indication of normal, worn, or failed operation from at least the first and additional state variables. For example, if the measurement of one of the first and additional state variables indicates a normal or worn or failed first component and the measurement of the other of the first and additional state variables indicates a failed first component, the determining means will determine that the first component is a failed first component. If the measurement of one of the first and additional state variables indicates a normal or a worn first component and the measurement of the other of the first and additional state variables indicates a worn first component, the determining means will determine that the first component is a worn first component. The determining means will determine that the first component is a normal first component only if the measurements of the first and additional state variables both indicated that the first component is a normal component. This can be extended to embodiments having more sensors, wherein the determining means will choose the worst indication of any sensor measuring a state variable of the first component in deciding if the first component is a normal, worn, or failed first component.

In one example, the first state variable is vibration, the second state variable is rotational speed, and the additional state variable is acoustic noise. Likewise, the first sensor 320 is a vibration sensor, the second sensor 322 is a rotational speed sensor, and the additional sensor 321 is an acoustic sensor. In one enablement, the determining means is a digital computer 332 which utilizes the data which is stored as a database on a hard drive 330 of the computer 332.

In one enablement, the computer 332 directs the first, second, and additional sensors 320, 322, and 321 to take additional measurements. The computer 332 also calculates deterioration rates of the first and additional state variables from the additional measurements. The computer additionally predicts a time-to-failure for the first component 314 which is the earlier of two time-to-failures for the first component 314. One of the two time-to-failures of the first component 314 is based on a latest measurement of the first state variable, the deterioration rate of the first state variable, and the data. The other of the two time-to-failures of the first component 314 is based on a latest measurement of the additional state variable, the deterioration rate for the additional state variable, and the data. In one example, the deterioration rate of the first state variable is assumed to be constant over time and the difference between the "lowest" failure value of the third range of values and the latest measurement of the first state variable is calculated, and one of the times-to-failure is computed by dividing that difference by that deterioration rate. Likewise, in this example, the deterioration rate of the second state variable is assumed to be constant over time and the difference between the "lowest" failure value of the sixth range of values and the latest measurement of the additional state variable is calculated, and the other of the times-to-failure is computed by dividing that difference by that deterioration rate.

In one example, the first, second, and additional sensors 320, 322, and 321 are disposed onboard the locomotive 312. The computer 332 is located onboard the locomotive 312 as shown in FIG. 4. Here, the locomotive diagnostic system 310 moreover includes an additional computer 333 which is remote from, and in satellite communication with, the computer 332 which is onboard the locomotive 312. The satellite communication is accomplished by connecting the computer 332 and additional computer 333 with separate satellite communication units 336. In one embodiment, the additional computer 333 communicates with the computer 332 via the communications satellite 334 at periodic intervals to download sensor measurements to be processed by the additional computer 333 or to download sensor measurements and failed, worn, and normal determinations of the first component 314 which were processed onboard the locomotive by the onboard computer 332. The additional computer 333 can keep and update the measurement history and performance operation (i.e., failed, worn, or normal) of all measured components of all the locomotives operated by the railroad to schedule appropriate and timely component replacement.

The foregoing description of several preferred embodiments of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

What is claimed is:

1. A locomotive diagnostic system for a locomotive having a first component and a second component, said system comprising:

a) a first sensor which is disposed in sensing proximity to said first component and which outputs a measurement of a first state variable of said first component, said first state variable indicative of the operation of said first component and said first state variable dependent on a second state variable of said second component;

b) a second sensor which is disposed in sensing proximity to said second component and which outputs a measurement of said second state variable;

c) an additional sensor which is disposed in sensing proximity to said first component, which outputs a measurement of an additional state variable of said first component, said additional state variable indicative of the operation of said first component and said additional state variable dependent on said second state variable of said second component;

d) data representing, for each of a plurality of different values of said second state variable, a first range of values of said first state variable which indicates a normal operation of said first component, a second range of values of said first state variable which indicates a worn operation of said first component, and a third range of values of said first state variable which indicates a failed operation of said first component, wherein said data also represents, for each of said plurality of different values of said second state variable, a fourth range of values of said additional state variable which indicates a normal operation of said first component, a fifth range of values of said additional state variable which indicates a worn operation of said first component, and a tertiary range of values of said additional state variable which indicates a failed operation of said first component;

e) means for determining if said measurement of said first state variable is within said first, second, or third range of values of said first state variable for said measurement of said second state variable and also for determining if said measurement of said additional state variable is within said fourth, fifth, or tertiary range of values of said additional state variable for said measurement of said second state variable; and f) wherein said determining means directs said first, second, and additional sensors to take additional measurements, wherein said determining means calculates deterioration rates of said first and additional state variables from said additional measurements, and wherein said determining means predicts a time-to-failure for said first component which is the earlier of two time-two-failures for said first component, wherein one of said two time-two-failures of said first component is based on a latest measurement of said first state variable, said deterioration rate for said first state variable, and said data, and wherein the other of said two time-two-failures of said first component is based on a latest measurement of said additional state variable, said deterioration rate for said additional state variable, and said data.

2. The system of claim 1, wherein said first state variable is vibration, wherein said second state variable is rotational speed, wherein said first sensor is a vibration sensor, and wherein said second sensor is a rotational speed sensor.

3. The system of claim 2, wherein said first and second components belong to a common locomotive replaceable unit.

4. The system of claim 3, wherein said replaceable unit is a locomotive blower fan, wherein said first component is a bearing set of said blower fan, and wherein said second component is a shaft of said blower fan.

5. The system of claim 1, wherein said first state variable is acoustic noise, wherein said second state variable is rotational speed, wherein said first sensor is an acoustic sensor, and wherein said second sensor is a rotational speed sensor.

6. The system of claim 1, wherein said data are derived from historical measurements of said first state variable from known failed, worn, and normal first components and from historical same-time corresponding measurements of said second state variable.

7. The system of claim 6, wherein said means for determining is a digital computer which utilizes said data.

8. The system of claim 6, wherein said computer directs said first and second sensors to take additional measurements, wherein said computer calculates a deterioration rate of said first state variable from said additional measurements, and wherein said computer predicts a time-to-failure for said first component based on a latest measurement of said first state variable, said deterioration rate, and said data.

9. The system of claim 8, wherein said first and second sensors and said computer are disposed onboard said locomotive.

10. The system of claim 1, wherein said determining means also determines if said first component is undergoing normal, worn, or failed operation based on the worst indication of normal, worn, or failed operation from at least said first and additional state variables.

11. The system of claim 10, wherein said first state variable is vibration, wherein said second state variable is rotational speed, wherein said additional state variable is acoustic noise, wherein said first sensor is a vibration sensor, wherein said second sensor is a rotational speed sensor, and wherein said additional sensor is an acoustic sensor.

12. The system of claim 10, wherein said determining means is a digital computer which utilizes said data.

13. The system of claim 12, wherein said first, second, and additional sensors and said computer are disposed onboard said locomotive.

14. The system of claim 13, also including an additional computer remote from and in satellite communication with said computer onboard said locomotive.

15. A locomotive diagnostic system for a locomotive having a first component and a second component, said system comprising:

a) a first sensor which is disposed in sensing proximity to said first component and which outputs a measurement of a first state variable of said first component, said first state variable indicative of the operation of said first component and said first state variable dependent on a second state variable of said second component;

b) a second sensor which is disposed in sensing proximity to said second component and which outputs a measurement of said second state variable, wherein said second state variable is rotational speed, wherein said first sensor is an acoustic sensor, and wherein said second sensor is a rotational speed sensor;

c) data representing, for each of a plurality of different values of said second state variable, a first range of values of said first state variable which indicates a normal operation of said first component, a second range of values of said first state variable which indicates a worn operation of said first component, and a third range of values of said first state variable which indicates a failed operation of said first component; and d) means for determining if said measurement of said first state variable is within said first, second, or third range of values of said first state variable for said measurement of said second state variable.

16. The system of claim 15, wherein said first component defines a first locomotive replaceable unit and wherein said second component belongs to a second locomotive replaceable unit which is different from said first locomotive replaceable unit.

17. The system of claims 16, wherein said first component is a locomotive engine cylinder head, and wherein said second component comprises a locomotive engine crankshaft.

* * * * *